United States Patent [19]

Carter et al.

[11] 4,065,649

[45] Dec. 27, 1977

[54] PRESSURE SENSITIVE MATRIX SWITCH HAVING APERTURED SPACER WITH FLEXIBLE DOUBLE SIDED ADHESIVE INTERMEDIATE AND CHANNELS OPTIONALLY INTERPOSED BETWEEN APERTURES

[75] Inventors: Everett M. Carter; Wilbur C. Quain, both of Winona, Minn.

[73] Assignee: Lake Center Industries, Winona, Minn.

[21] Appl. No.: 695,968

[22] Filed: June 14, 1976

Related U.S. Application Data

[63] Continuation-in-part of Ser. No. 591,772, June 30, 1975, abandoned.

[51] Int. Cl.[2] ..... H01H 13/70

[52] U.S. Cl. ..... 200/5 A; 200/86 R; 200/159 B; 200/302

[58] Field of Search ..... 200/5 R, 5 A, 159 B, 200/264, 265, 262, 292, 302, 340, 86 R, 239

[56] References Cited

U.S. PATENT DOCUMENTS

| | | | |
|---|---|---|---|
| 3,627,927 | 12/1971 | Schmitz et al. | 200/159 B UX |
| 3,718,791 | 2/1973 | Szablowski | 200/86 R X |
| 3,728,509 | 4/1973 | Shimojo | 200/159 B |
| 3,735,068 | 5/1973 | Yanaga et al. | 200/159 B |
| 3,743,797 | 7/1973 | Hoffman | 200/5 R X |
| 3,749,859 | 7/1973 | Webb et al. | 200/5 R |
| 3,806,685 | 4/1974 | Seeger, Jr. et al. | 200/159 B X |
| 3,860,771 | 1/1975 | Lynn et al. | 200/5 A |
| 3,862,381 | 1/1975 | Glaister et al. | 200/5 A |
| 3,862,382 | 1/1975 | Glaister et al. | 200/5 A |
| 3,879,586 | 4/1975 | DuRocher et al. | 200/159 B X |
| 3,886,012 | 5/1975 | Slater | 200/5 A X |
| 3,886,335 | 5/1975 | Hendricks | 200/5 R X |
| 3,898,421 | 8/1975 | Suzumura | 200/159 B |
| 4,018,999 | 4/1977 | Robinson et al. | 200/239 X |

FOREIGN PATENT DOCUMENTS

| | | | |
|---|---|---|---|
| 2,256,992 | 6/1973 | Germany | 200/86 R |

OTHER PUBLICATIONS

J. R. Lester et al.; IBM Tech. Disc. Bull.; "Switch"; vol. 11, No. 11, 4–1969; p. 1569.

*Primary Examiner*—James R. Scott
*Attorney, Agent, or Firm*—Kinzer, Plyer, Dorn & McEachran

[57] ABSTRACT

This is concerned with a switch device which is quite thin and can be used on either a flat or a contoured surface that includes a backing member which may be dimensionally stable, either as a flexible or a stiff membrane, with a flexible membrane spaced therefrom by a flexible filled adhesive material providing one or more openings so that a circuit pattern on the backing member is spaced from a conductive shorting bar on the flexible membrane such that manual or mechanical deformation of the membrane will cause electrical conduction across or between the contacted surface in the circuit pattern with deformation being provided by the flexibility of the membrane, as well as deflection or flexing of the intermediate adhesive material.

9 Claims, 5 Drawing Figures fig.3.
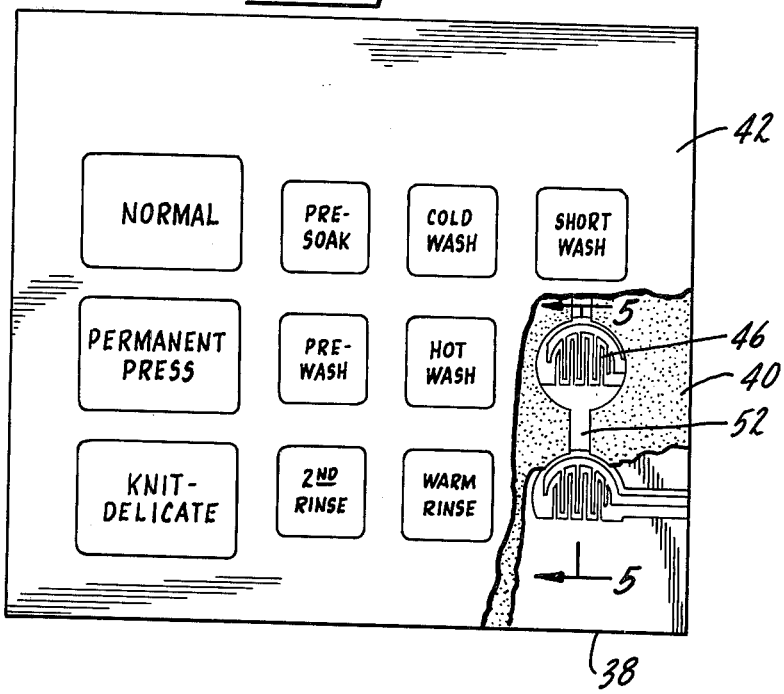
fig.4.
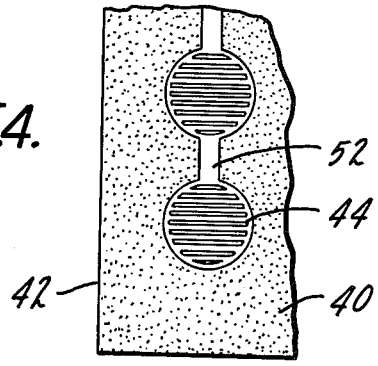
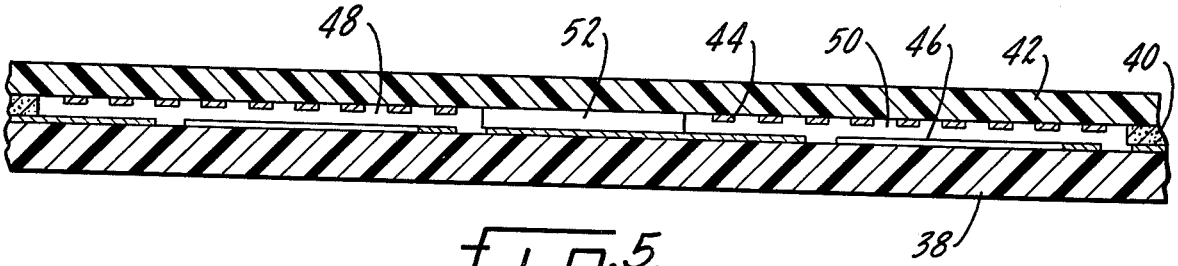
fig.5.

PRESSURE SENSITIVE MATRIX SWITCH HAVING APERTURED SPACER WITH FLEXIBLE DOUBLE SIDED ADHESIVE INTERMEDIATE AND CHANNELS OPTIONALLY INTERPOSED BETWEEN APERTURES

SUMMARY OF THE INVENTION

This application is a continuation-in-part of application Ser. No. 591,772, filed June 30, 1975, now abandoned.

This invention is concerned with a switch device that more specifically relates to a quite thin switch which may be rigid or flexible and presents a smooth top surface or front face.

A primary object is a switch of the above type which is inexpensive and reliable.

Another object is a switch of the above type which is quite thin and may be either rigid or flexible.

Another object is a switch that can be applied and adhered to a contoured surface which may be metallic or otherwise.

Another object is a switch of the above type which is quite reliable.

Another object is a switch of the above type which is unitized or self-integrated and does not have to be held together by a bezel, pins, rivets or what-have-you.

Another object is a switch of the above type which is hermetically sealed.

Another object is a switch in which all of the switch contactors are on the switch contact layer which eliminates the necessity of making permanent electrical contact to a flexible surface and thereby provides a double break switch which uses shorting bars.

Another object is a switch which uses edge-type contacts, whether rigid or flexible, and thereby eliminates the costly bonding of conductors to deposited material.

Another object is a switch of the above type which provides a pluggable unit.

Another object is a switch of the above type in which the bezel may be only cosmetic or provides only cursory alignment.

Another object is a switch of the above type which provides bonded contoured construction aand thereby eliminates the need for flat, plane control surfaces.

Another object is a switch of the above type in which assembly may be provided or achieved over a contoured backing plane that is already in existence as a part of existing structure.

Another object is a switch of the above type that reduces the area of deposited conducted material.

Another object is a switch of the above type which allows for practically an unlimited variety or combinations on the switch contact layer.

Another object is a switch that provides definite cost and reliability advantages over present techniques by reducing the area of deposited conductive material from major sheet deposits to small shorting pads, bars, concentrics, or spirals, therefore allowing the tailoring of switch requirements to the application.

Another object is a switch of the above type with a pumping action between adjacent switch areas which greatly facilitates a quick return or recovery of a given area when an adjacent area is depressed.

Other objects will appear from time to time in the ensuing specification and drawings.

BRIEF DESCRIPTION OF THE DRAWINGS

FIG. 3 is a top plan view of a variant form, similar to FIG. 1;

FIG. 4 is a bottom view of the front layer or overlay of FIG. 3; and

FIG. 5 is a section along line 5—5 of FIG. 3 on an enlarged scale.

DESCRIPTION OF THE PREFERRED EMBODIMENT

Figure 1:
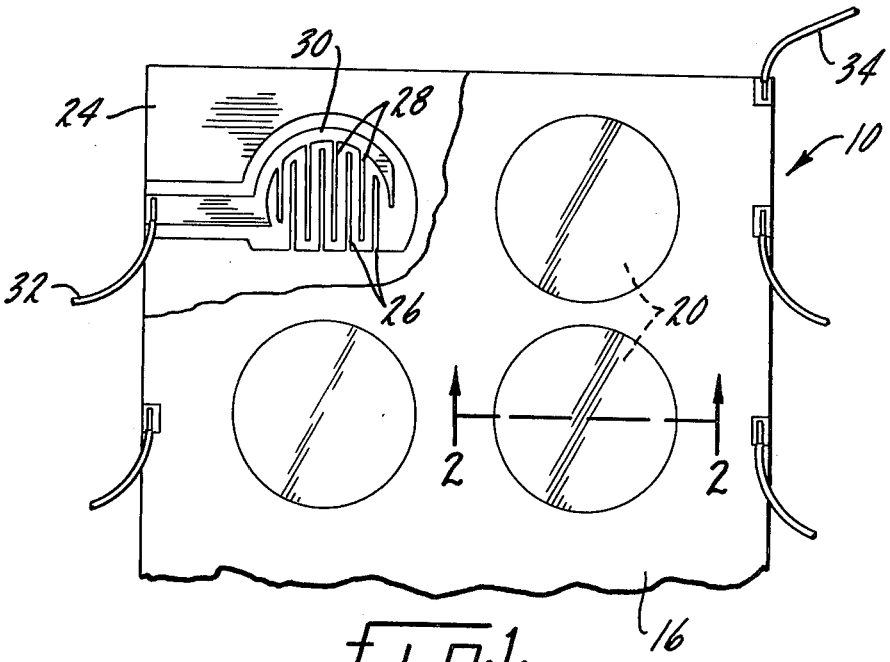
FIG. 1 is a top plan view of a part of a keyboard according to the invention.

In FIG. 1 a typical switch panel has been indicated generally at 10 and includes a back plane or body member 12, an intermediate or spacing member 14, and a front layer or overlay or front membrane 16. The back plane 12 may be any suitable support member and has for its sole or primary function providing a rigid or flexible body for the construction. It could be a printed circuit board, for example, if the application is to be fairly rigid, or it might be of a more flexible material, such as Mylar. The spacing member 14 is preferably a filled adhesive which bonds to the upper surface of the base member or back plane and is insulating in nature. It may be any suitable adhesive filled with finely divided particles, for example of Mylar, which will give the intermediate flexible adhesive layer its depth stability. Suitable openings, such as at 18, are provided in the flexible adhesive which may be round, as shown in FIG. 1, or of any other suitable geometric configuration which provide the switch points.

Figure 2:
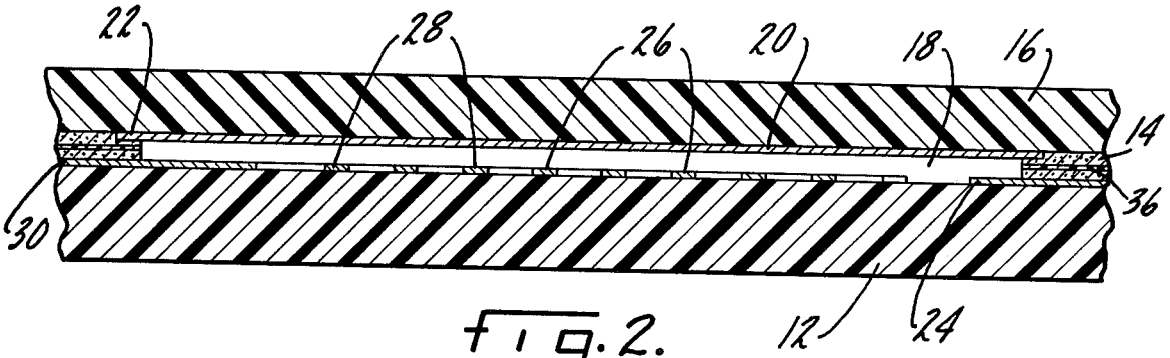
FIG. 2 is a section taken along line 2—2 of FIG. 1, on an enlarged scale.

The overlay 16 may be of Mylar and carries on its lower surface a shorting bar or pad 20 which, as shown in FIG. 1, may also be round and slightly overlaps the edges of the opening 18 in the intermediate layer, as at 22. The shorting bars or circles 20 may bemade of a silver epoxy paint which is coated on the lower surface of the Mylar overlay 16 and has very pronounced flexibility so that the Mylar is depressed downwardly in FIG. 2, the shorting bars or rings will conform thereto with free flexibility without any cracking, chipping or resistance to the flexing of the overlay.

The upper surface of the base or back material carries switch contacts which may be a thin layer 24 over substantially all or most of the back plane with suitable fingers 26 or the like projecting into the openings 18 in the spacer. The fingers 26 interfit or alternate between similar fingers 28 on a contact member 30 which, as shown in FIG. 1, is isolated from the switch contact sheet 24 and fingers 26 and leads off to the side to a suitable contact 32 or the like. The main switch contact sheet may also have a suitable lead 34. It will be noted that each one of the switches has its own individual lead 32, all of which are isolated in the manner shown in FIG. 1.

We may also provide a wafer thin sheet of Mylar 36 in the middle of the flexible adhesive or between the upper and lower surfaces thereof which will give position stability. In certain installations where the intermediate flexible adhesive 14 is thicker, two such wafer thin Mylar intermediates 36, suitably spaced, might be used. On a single switch, it might not be necessary to use the Mylar wafer 36 in the flexible adhesive, but we consider it desirable in a multiple switch or sheet setup.

In FIGS. 3 through 5 a variant form has been shown in which a similar back plane or body member 38 has an intermediate or spacing member 40 with a front layer or overlay or front membrane 42 adhering thereto, similar to the previous form. The lower surface of the overlay 42 carries a series of shorting bars in a grid pattern 44, in FIG. 4, which is disposed at right angles, when assembled, to the pattern of the printed circuit or contact switch members 46, in FIG. 3. Two openings 48 and 50 are shown for adjacent switches, with a channel of air passage 52 in the spacing member or flexible adhesive interconnecting the two. Such passage or channel has the advantage that when one contact area is depressed, the air will be forced through the channel in a pumping action to inflate somewhat the adjacent opening which will aid or cause a quick return of a depressed area.

In FIG. 3 it will be noted that certain indicia has been placed over each area and the upper surface of the overlay has been marked or circumscribed to indicate to the user where the pressure should be applied. Also, three such openings or pressure areas are or may be interconnected by channels so that multiple pumping function may take place. Since each opening is hermetically sealed, both top and bottom, by the flexible adhesive and two or more such openings are interconnected by a channel, the air can only flow from one to the other, which will assist in the quick return of a depressed area to its normal state.

The use, operation and function of the invention are as follows:

The switch is operated by pressing down in the center of one of the switch areas, for example by using your finger. The Mylar overlay 16 will deflect downwardly as will the shorting pad 20 which, when it connects across the fingers 26 and 28, will close the circuit for one of the switches. The overlay 16 may be considered distortable or flexible, but not elastic to any substantial degree. And at the time that the switch area of the Mylar overlay is depressed, the intermediate spacer, which is a filled adhesive, will also deflect somewhat so that it participates in the deflection of the Mylar membrane.

The filled adhesive spacer performs a number of functions. For example, it adheres both to the backing member and the overlay, thereby providing a dimensionally stable, composite, unitized sandwich construction. The composite switch does not require any pins or extra gluing or a bezel to hold the entire structure together. Also, the flexible adhesive provides uniform spacing between the backing and the overlay and at the same time hermetically seals around the switch and contacts so that one switch is isolated from another. The flexible adhesive is insulating in nature and nonconductive. Thus there is very little, if any, interaction between adjacent switches. Since the flexible adhesive will participate in the deflection of the Mylar overlay and performs a bending action, it also has a spring function and will also participate in the return action of the Mylar when it is released. Since the flexible adhesive will bend and return, there will be no tendency for the adhesive to drift over a period of time as the Mylar is repeatedly depressed. The flexible adhesive should be of a type that will stay flexible over a period of time and not get rigid or hard. It also should have a tendency to resist any cold flow.

A particularly flexible adhesive which works quite well is one sold under the designation Part No. 8194 by the Northern Flexible Products Company of Sparta, Wisconsin. However, the invention is not restricted to that particular formulation and could as well be applied or used with other flexible adhesives which have the same or similar characteristics as to flexibility, hermetic sealing, insulation, resistance to drift, etc. that will do the job.

The shorting bars or discs 20 have been referred to as a silver epoxy paint and this is preferred since it has excellent flexibility and will not resist the flexing of the Mylar or crack in the process as the plastic memory of the Mylar and the flexible adhesive causes it to return.

Two sets of interfitting fingers 26 and 27 have been shown as the switch pattern, but it should be understood that more could be used. Also, the pattern could be worked out in any one of a number of geometric configurations, for example spirals with or without strips, fingers, etc.

With the filled adhesive acting as kind of a hinge, the thickness of the Mylar overlay may be varied and the thickness of the adhesive may also be varied and tailored to the thickness of the Mylar so that the pressure to activate the switch may be quite accurately chosen and obtained. For example, it could be in the neighborhood of 2 to 4 ounces, if desired.

Also, the undersurface of the Mylar overlay 16 could be decorated, either with a pattern or with words, such as "Stop" and "Start" and the decoration would not be rubbed off in use. Additionally, instead of using a hard backing, a Mylar flexible back of any chosen thickness could be used so that the switch could be contoured to a curvilinear surface, such as the dashboard of an automobile.

In all cases where we have referred to the use of Mylar, it should be understood that other equivalent materials with the dimensional stability and flexibility of Mylar could be used. The shorting bars or rings could be put on the lower surface of the Mylar overlay by a subscreen process, but it could be otherwise. And the thickness of the shorting bars may be closely controlled or set so that switch voltage drop could be accurately controlled. At the same time, the current conduction limit in the switch may be accurately controlled by the thickness of the printed circuit pattern of the base material.

A unit of this nature has the advantage of having a smooth front face and, at the same time, is very thin. As examples, and not by way of limitation, the backing 12 might be something on the order of from 4 to 10 mils the flexible adhesive or spacer 14 might be on the order of something like 4 mils, and the Mylar overlay 16 might be on the order of 10 mils, which would give a composite thickness of something like 15 to 25 mils. The shorting bars might be no more than half a mil, with the copper switch contacts something like half a mil, but they do not figure in the thickness of the sandwich. At the same time, the amount of pressure required to effect the switch, as well as the switch response time to pressure removal, may be closely set by varying and setting the thicknesses of the overlay and the adhesive filled spacer. The conductive pattern that is chosen for the printed circuit pattern and the material used may control when an interface method is used to associate components, the voltage breakdown, the current conduction limit, and the switch voltage drop. The deposited shorting bars affect the current limit and switch voltage drop. The copper foil that is laminated to the backing could be applied by an etching process to form the switch points, the traces interconnecting and the card edge connector. The entire structure could be applied to a metal backing, in which case the contacts could be deposited conductive material on a Mylar carrier with all traces and the card edge connector incorporated. The Mylar carrier could then be bonded to a metal frame. The edge connector could be on an extension of the Mylar carrier to form a ribbon cable. The decorative pattern on the second or undersurface of the overlay may be processed thereon after which the conducting patterns or shorting bars may be deposited in appropriate registration to line up with the holes or openings in the flexible adhesive spacer.

The pumping action referred to above can be acquired by interconnecting two depressible areas so that the air will flow from one to the other which will assist in a quick return of a given area when the adjacent area is depressed. The flexible adhesive is particularly useful as the intermediary between the top and bottom layer because it hermetically seals the adjacent depression area except for the channel so that the air will flow back and forth as one or the other is depressed.

While a preferred form and several variations of the invention have been shown and suggested, it should be understood that suitable additional modifications, changes, substitutions and alterations may be made without departing from the invention's fundamental theme.

The embodiments of the invention in which an exclusive property or privilege is claimed are defined as follows:

1. In a switch control device, a backing layer with a printed circuit having switch conductors on the upper surface thereof defining at least one switch contact area, a flexible adhesive insulating layer adhering to the upper surface of the backing layer with at least one opening around the switch contact area, and a flexible contact layer adhering to the upper surface of the adhesive insulating layer and overlying the opening with a conductive shorting bar on the lower surface thereof aligned with the opening over the contact area, the flexibility and thickness of the adhesive insulating layer causing it to participate in the deformation of the contact layer to allow for contact of the shorting bar with the switch contact area without elongation of the contact layer when the contact layer is pressed toward the backing layer in the area aligned with the opening in the flexible adhesive insulating layer and causing spring return of the contact layer when such pressure is released, the adhesive insulating layer adhering to the upper surface of the backing layer and the lower surface of the contact layer to structurally retain the dimensional stability of the switch control device.

2. The structure of claim 1 further characterized in that the flexible contact layer is made of Mylar and is on the order of 0.010 inches (0.25 mm.) in thickness.

3. The structure of claim 1 further characterized by and including a thin reinforcing sheet disposed in the flexible adhesive insulating layer intermediate and generally parallel to the backing and flexible contact layer.

4. The structure of claim 1 further characterized in that the backing layer is flexible.

5. The structure of claim 1 further characterized in that the lower surface of the flexible contact layer is decorated.

6. The structure of claim 1 further characterized in that the adhesive insulating layer adheres both to the lower surface of the contact layer and the upper surface of the backing layer so as to hermetically seal the opening with the switch contact area and shorting bars.

7. The structure of claim 1 further characterized in that the conductive shorting bar on the lower surface of the flexible contact layer is in the form of silver epoxy paint.

8. The structure of claim 1 further characterized in that the backing layer is rigid.

9. The structure of claim 1 further characterized by and including two switch contact areas, and a channel in the insulating layer interconnecting the two contact areas so that a pumping action may occur between the two areas when the contact layer is pressed toward the backing layer in the area aligned with one opening causing air to be pumped through the channel into the other area.

* * * * *